United States Patent [19]

Mall

[11] Patent Number: 4,732,096

[45] Date of Patent: Mar. 22, 1988

[54] DEVICE FOR CONTROLLING THE POSITIONING OF A WORKPIECE IN A SEWING MACHINE

[75] Inventor: Gunther Mall, Kaiserslautern, Fed. Rep. of Germany

[73] Assignee: Pfaff AG, Fed. Rep. of Germany

[21] Appl. No.: 83,702

[22] Filed: Aug. 7, 1987

[30] Foreign Application Priority Data

Aug. 7, 1986 [DE] Fed. Rep. of Germany ..... 3626761

[51] Int. Cl.[4] ..... D05B 21/00; D05B 69/36

[52] U.S. Cl. ..... 112/121.12; 112/272

[58] Field of Search ..... 112/121.12, 121.15, 112/272, 220, 221, 67, 87

[56] References Cited

U.S. PATENT DOCUMENTS 4,555,998 12/1985 Martin ..... 112/121.12
4,615,287 10/1986 Henze et al. ..... 112/272 X
4,681,048 7/1987 Willenbacher ..... 112/121.12 X
4,682,553 7/1987 Bachmann et al. ..... 112/121.12
4,688,498 8/1987 Carlson ..... 112/121.12 X
4,694,762 9/1987 Takano et al. ..... 112/121.12

*Primary Examiner*—H. Hampton Hunter
*Attorney, Agent, or Firm*—McGlew and Tuttle

[57] ABSTRACT

A sewing station has a sewing machine and a feed device with a holder for the product being stitched that is driven by at least one drive mechanism to execute a predeterminable course of motion. To prevent damage or destruction of components of the stitching area from deviations of the holder for the produce being stitched from the predetermined course of motion, the stitching station has a monitor that includes a marking and a sensor conforming to the form of stitch to be made. These are movable relative to one another as a function of the motion of the holder for the product being stitched. The sensor is connected to a control circuit to emit a switching signal after the occurrence of an error.

11 Claims, 5 Drawing Figures

DEVICE FOR CONTROLLING THE POSITIONING OF A WORKPIECE IN A SEWING MACHINE

BACKGROUND OF THE INVENTION

1. Field of the Invention

This invention relates in general to machines, and a sewing station therefore and in particular to a new and useful device for controlling the positioning of a workpiece in a sewing machine.

U.S. Pat. No. 4,555,998 discloses a feed device with a steering mechanism which holds a holder for the product being stitched and that is guided in two coordinate directions. The steering mechanism is driven by stationary stepping motors that execute an appropriate number of drive steps overlapping in time to move the product being stitched in the desired manner. The stepping motors can be controlled by a microcomputer that calculates the necessary number of drive pulses from position data that are taken from a memory.

When the control and the stepping motors operate routinely, the feed device operates satisfactorily. However, when there are disturbances in the control or drive areas, there is a risk that the holder for the product being stitched will execute a motion other than the predetermined motion, for example when data are lost from the memory by polling or by transmission to the stepping motors. The needle can then strike outside of the recesses provided on the holder for the product being stitched, and can be damaged or destroyed. The invention provides a construction for a sewing machine capable of preventing damage or destruction of components of the stitching area of a sewing station having a feed device when its holder for the product being stitched executes a motion differing from a predetermined motion.

There is a motion relationship determined by the transmission mechanism between any arbitrarily selected point on the holder of the product being stitched and one of the parts movable relative to the sewing machine provided to drive or guide the holder from the product being stitched. For this reason, the motion of the holder for the product being stitched can be monitored at any arbitrary mechanically suitable and advantageously readily accessible point on these parts if the motion relationship is known.

The sensor used can operate optoelectronically, electromagnetically, pneumatically, or mechanically, and has a transmitter and a receiver, or in the case of mechanical design, a sensor pin and a limit switch. The marking, for example, is designed as a device to be monitored, as a line drawn on a plate or as a scanning slit provided in the plate, and is designed so that it conforms to a stitching slit incorporated in the holder for the product being stitched with consideration of the motion relationships of the feed device based on the transmission mechanism.

The sensor device and the marking execute a motion relative to one another in which one of the two devices is held on at least one of the movable parts of the feed device, while the other device is in a stationary position in its range of motion. Because of this measure, a deviation from a predetermined motion is detected immediately by the sensor.

The switching signal triggered by the monitor can produce a correction of the error in dependence on the design of the control circuit controlling the drive mechanism, for example, so that the holder for the product being stitched is moved along with the predetermined course of motion. Another possibility is to turn off the drive mechanism through the control circuit until the error is eliminated.

In one embodiment the sewing station has an optoelectronic sensor device, since the receiver of such a system reacts extraordinarily rapidly and sensitively to a very slight change of the amount of light. In addition, the scanning head can be placed at a favorable, readily accessible location at some distance from the marking, without its accuracy of measurement being significantly affected thereby.

Another embodiment makes it possible, after a change of the form of stitching, to interchange the plate having a different marking with the previously used plate in the shortest possible changeover time by seating it on the carrier.

In one embodiment the sensed signal turns off the drive and prevents damage to components of the stitching area of the sewing station by relatively simple means of control.

Accordingly, it is an object of the invention to provide a device for controlling the positioning of a workpiece in a sewing machine which has a drive for a needle which reciprocates at a sewing station in order to sew the workpiece, and which comprises a holder engageable with the workpiece for advancing it through the sewing station in a selected path; and which includes a feed device driven by the drive and connected to the holder for moving the holder with the workpiece, and which also has a monitoring means associated with the holder for monitoring the position of the holder with the workpiece and connected to the feeding device for controlling the movement of the holder.

An object of the invention is to provide a sewing station for a sewing machine which has a feed device which comprises a holder for the workpiece being stitched that is driven by the feed device or drive mechanism to execute a predeterminable motion, which also includes a monitor moveable as a function of the motion of the holder which has markings corresponding to a predetermined motion and which includes a sensor which scans the markings and a control circuit which is connected to the sensor and the feed device which emits switching signals to the feed device when the holder for the product being stitched deviates from the predetermined motion.

A further object of the invention is to provide a scanning control device for the operation of a sewing machine feeding mechanism, which includes a holding plate for guiding the workpiece having a stitch slit opening to which the needle is moveable to sew the workpieces, and which includes means for scanning movement of the holder so as to regulate the feed of the holder through the operation of two separate stepping motors which acts to drive the feed mechanism to position the holder.

A further object of the invention is to provide a device for controlling the positioning of a workpiece in respect to a reciprocating needle, which is simple in design, rugged in construction and economical to manufacture.

GENERAL DESCRIPTION OF THE PREFERRED EMBODIMENTS

Figure 1:
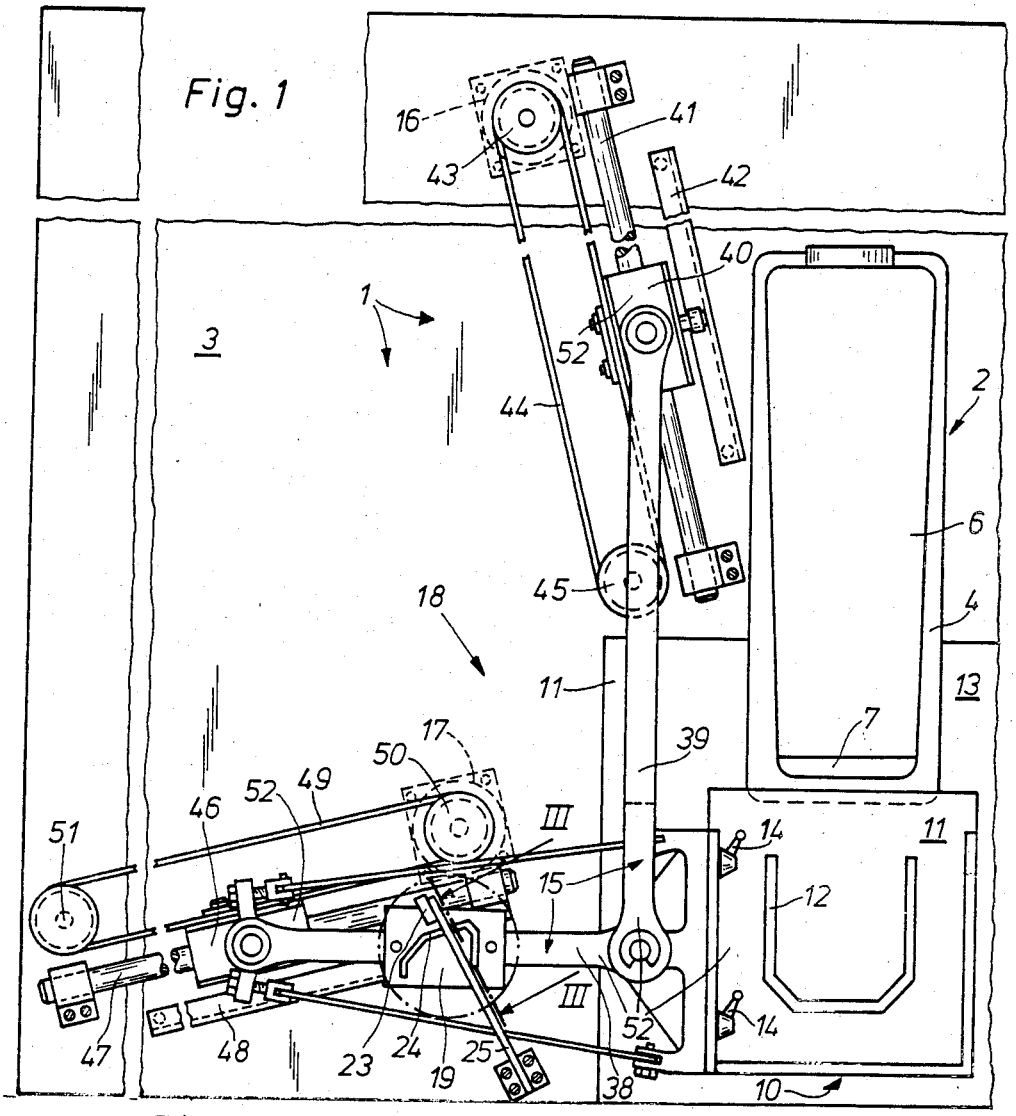
FIG. 1 is a top plan view of the sewing station of a sewing machine constructed in accordance with the invention.

Referring to the drawings in particular, the invention embodied therein comprises a device for controlling the positioning of a workpiece in a sewing machine generally designated (2) having a drive for reciprocating a needle (9) at a sewing station to sew a workpiece which is held by a holder (10). The holder (10) is engagable with the workpiece for advancing it through the sewing station through a selected path, and it has a stitching slit (12) which forms a guide path for the movement of a sewing needle through the stitching slit. The sewing machine includes a feed device (18), driven by a sewing machine drive which is connected to the holder (10) for moving the holder with the workpiece. The arrangements include monitor means (28) associated with the holder (10) for monitoring the position of the holder and it is connected to the feeding device (18) for controlling the movement of the holder (10).

The invention provides a sewing station for the sewing machine which has the feed device (18), which includes at least one drive mechanism to execute a predeterminable motion. Monitor (28) is moveable as a function of the motion of the holder (10), and has a marking (24) corresponding to a predetermined motion in a sensor (23) which scans the marking and operates a control circuit (37), which is connected thereto into the feed device and emits a switching signal to the feed device when the holder (10) for the product being stitched deviates from predetermined motion.

A sewing station generally designated (1) of a sewing machine (2) is placed on a table plate (3). The sewing machine (2) includes a base plate (4), a post (5), and an arm (6) that changes into a head (7). A needle bar (8) that carries a needle (9), and is driven in a known manner, is mounted in the head (7). A holder (10) for the product being stitched with a plate (11) gripping the workpiece positively by friction, into which is incorporated a stitching slit (12) conforming to the shape of the stitch to be made for the passage of the needle (9), is used to hold a workpiece. The plate (11) rests on a support plate (13) connected to the table plate (3), whose top is flush with the top of the base plate (4). The holder (10) for the product being stitched is detachably connected by Tommy-screws (14) to a steering mechanism (15) that is driven by at least one drive mechanism, for example by stepping motors (16,17). The steering mechanism (15), like the holder (10) for the product being stitched, is part of a feed device (18).

Figure 3:
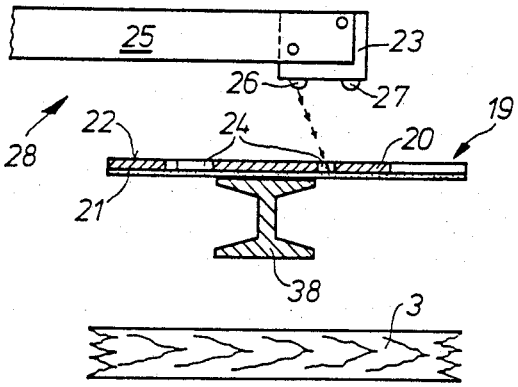
FIGS. 3 and 4 are section views taken along the line III—III of FIG. 1 at different stages of operation.
Figure 4:
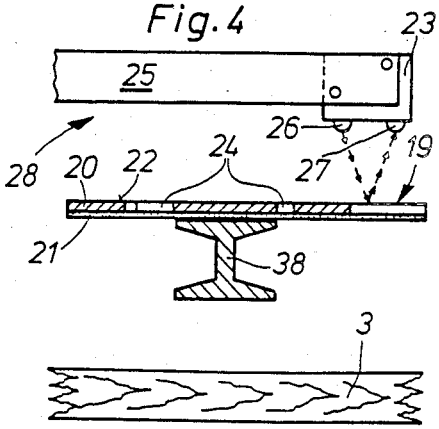
Figure 2:
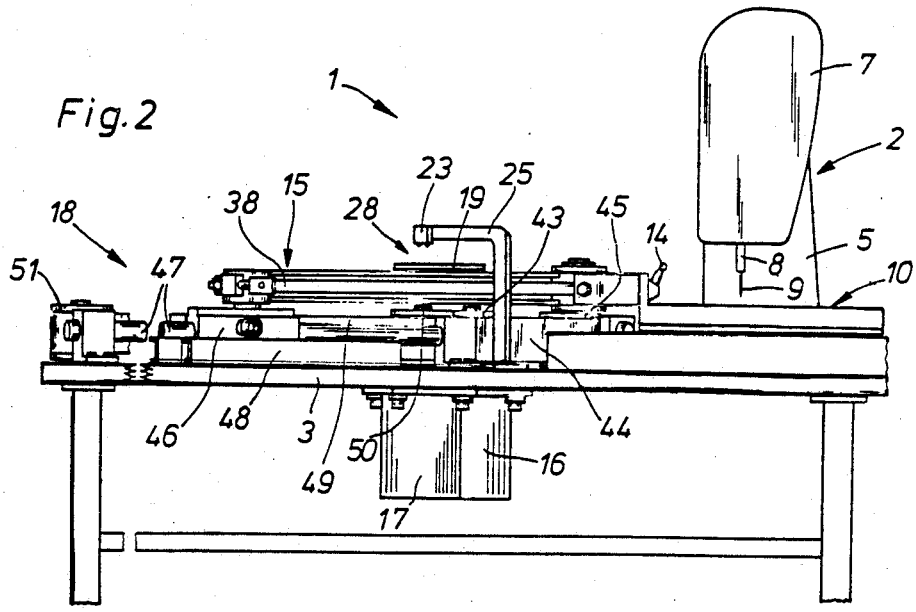
FIG. 2 is a front elevational view of the sewing station.

A carrier (19) that is used to hold a reflecting plate (20) and a cover plate (21) (FIGS. 3 and 4) is fastened to the steering mechanism (15). The surface (22) of the top face of the reflecting plate (20) in FIGS. 3 and 4 is polished so that light beams from an optoelectronic sensor device (23) striking it and shown by arrows are reflected on it. The reflecting plate (20) has a scanning slit (24) as a marking, whose size and shape corresponds to the stitching slit (12) of the holder (10) for the product being stitched as a function of the motion relationships of the steering mechanism (15) determined by the transmission. The reflecting plate (20) is covered on the bottom by the cover plate (21) whose surface facing the reflecting plate (20) is of light-absorbing design.

A stationary post (25) connected to the table plate (3) is fastened in the range of motion of the carrier (19), and holds the sensor device (23) designed as an optoelectronic scanning head. This has an LED (26) to emit light beams and a photodector (27) to receive light beams reflected on the reflecting plate (20). The sensor device (23) together with the carrier (19) constitutes a monitor (28).

In contrast to the arrangement illustrated in FIGS. 3 and 4 in which the carrier is carried by the steering mechanism (15), the carrier (19) can also be fastened to the post (25) and the sensor device (23) can be fastened to the steering mechanism (15). In spite of this kinematic reversal, the method of operation of the monitoring device (28) remains unchanged.

Figure 5:
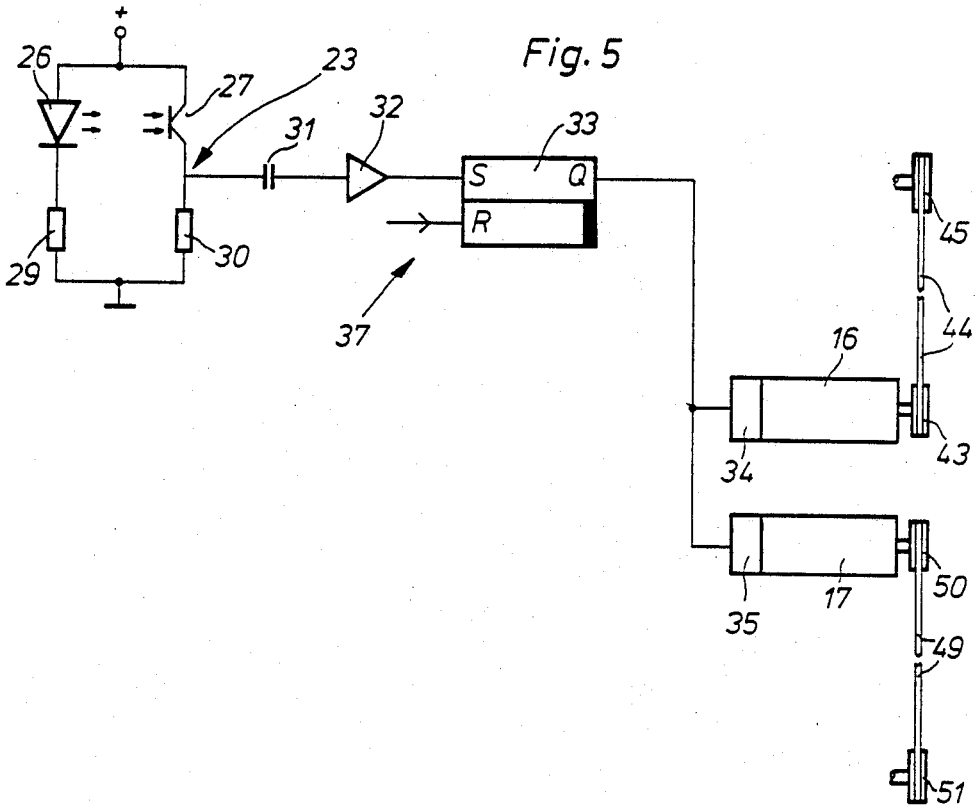
FIG. 5 is a simplified circuit diagram of the control of the sensor device.

The necessary electronic components for monitoring the motions of the holder (10) for the product being stitched are illustrated in a simplified block diagram in FIG. 5. Current from the positive pole of a regulated source of voltage flows through the LED (26) and a resistor (29) to the grounds. In the same way, current flows from the positive pole of the voltage source through the photodetector (27) designed as a phototransitor, and a resistor (30), to the ground.

Connected to the emitter of the photodetector (27) is a capacitor (31) that is connected through an amplifier (32) to the setting input S of a flip-flop memory (33). The output (Q) of the flip-flop memory (33) is connected to devices (34,35) to turn off the stepping motors (16,17).

The components illustrated in FIG. 5 connected to the sensor device (23) form a control circuit (37).

The steering mechanism (15) of the feed device (18) has a pivot arm (38) with which is engaged a pivoting connecting rod (39). The opposite end of the connecting rod (39) has a hinged connection to a carriage (40). This is mounted to move on a slide bar (41) fastened to the table plate (3) and is secured against pivoting motions around the slide rod (41) by a guide rail (42) running parallel to it.

The stepping motor (16) is located on the bottom of the table plate (3). Fastened to its shaft passing through the table plate (3) is a toothed belt pulley (43) that carries a toothed belt (44), which runs at its opposite end around a reversing pulley (45) mounted to rotate on the table plate (3) and connected firmly to the carriage (40).

The pivot arm (38) of the steering mechanism (15) is mounted to pivot on a carriage (46) that is positioned to move on a slide rod (47) in the identical manner as the carriage (40), and is secured against rotational motions by a guide rail (48) and is connected to a toothed belt (49) that runs over a pulley (50) and a reversing pulley (51). The pulley (50) is fastened to the shaft of the stepping motor (17) that is likewise located beneath the table plate (3).

The parts of the feed device (18), such as the carriages (40,46), the steering mechanism (15), and the holder (10) for the product being stitched, whose position can be changed relative to the sewing machine (2) during the execution of a stitch on a workpiece, constitute the movable parts (52) of the feed device (18).

The sewing station operates as follows:

The stepping motors (16,17) execute controlled drive steps. The stepping motors (16,17) are controlled by a known microcomputer, not shown, that calculates the particular number of drive pulses necessary for each of the two stepping motors (16,17) from position data that are prescribed by a program contained in a memory, not illustrated. The drive steps of the stepping motors (16,17) are transmitted through the toothed belts (44,49) to the carriages (40,46), and thus to the steering mechanism (15).

After the sewing station (1) is turned on, the holder (10) for the product being stitched is moved in the described manner out of the rest position shown in FIG. 1 into the stitching position. The stitching slit (12) of the holder (10) for the product being stitched holding a workpiece is located there, just below the needle (9). In the normal operation of the control, the holder (10) for the product being stitched is driven in a manner determined by the program during the following stitching process, so that the needle (9) pierces only in the area of the stitching slit (12).

At the same time, the scanning slit (24) of the carrier (19) is constantly scanned by the sensor device (23). As soon as the holder (10) for the product being stitched is moved into a different position, the carrier (19) connected to the steering mechanism (15) is also positively pivoted into a different position coordinated with the position of the holder (10) for the product being stitched in the monitoring range of the sensor device (23). As long as the holder (10) for the product being stitched executes a motion corresponding to the stitching slit (12), the light beams emitted by the LED (26) pass through the scanning slit (24) to reach the cover plate (21), whose light-absorbing surface prevents a reflection of the light beams. Because of this, the photodetector (27) receives no reflected light beams (FIG. 3). However, as soon as the holder (10) for the product being stitched executes a motion differing from the predetermined course of motion, the emitted light beams strike the reflecting surface (22) of the reflecting plate (20) outside of the scanning slit (24) and are reflected on it to reach the photodetector (27) (FIG. 4).

When the photodetector (27) receives light beams, it becomes conductive and current flows through the resistor (30) to the ground. The voltage building up in this case is fed through the capacitor (31) and the amplifier (32) to the setting input S of the flip-flop memory (33). The capacitor (31) serves beneficially here to filter out direct currents caused by daylight and low-frequency alternating currents caused by sewing light.

With the first pulse from the photodetector (27), the flip-flop memory (33) simultaneously actuates the turn-off devices (34,35) through its output Q. This turns off the stepping motors (16,17) immediately and prevents their restarting until the error is corrected. This prevents the needle (9) from striking the stitching slit (12) laterally and thus being broken.

After correction of the error, an electric signal is applied to the reset input R of the flip-flop memory (33) in a suitable way, for example by the seamstress operating an unlock switch, not shown, so that it again releases the stepping motors (16,17).

The marking provided on the reflecting plate (20) of the carrier (19) described in the example of embodiment, for example, can also be made as a line drawn on the reflecting plate (20) instead of the machined scanning slit (24). This is then likewise monitored by the sensor device (23). For this purpose, the sensor device (23) held on the post (25) is taken off and replaced by a marking pin. During the following, one-time cycle, the holder (10) for the product being stitched is moved beneath the needle (9) in the desired manner. At the same time, the marking pin draws a line on the surface (22) of the reflecting plate (20) corresponding to the stitching slit (12). After completion of the marking, the marking pin is again replaced by the sensor device (23). The line drawn on the reflecting plate (20) can be monitored thereafter by the sensor device (23).

Instead of the drive mechanism with program-controlled stepping motors (16,17) described in the example of embodiment, the drive can also be accomplished in a different way, for example by plate cams designed and driven in a known way, whose cam grooves predetermine the course of motion of the holder (10) for the product being stitched.

What is claimed is:

1. A sewing station for a sewing machine having a feed device, comprising a holder for the workpiece being stitched connected to said feed device being driven thereby to execute a predeterminable motion, a monitor movable as a function of the motion of said holder having a marking corresponding to a predetermined motion, a sensor scanning said marking, a control circuit connected to said sensor and to said feed device and emitting switching signals to said feed device when said holder for the product being stitched deviates from a predetermined motion.

2. A sewing station according to claim 1 wherein said feed device has a movable part holding said marking and including a stationary sensor positioned to react with said movable part said movable part being movable with respect to said sensor.

3. A sewing station according to claim 1 wherein said feed device includes a movable part carrying said sensor and including a stationary marking along the path of said sensor.

4. A sewing station according to claim 1 wherein said sensor comprises an optoelectronic scanning head having an LED and a photodetector.

5. A sewing station according to claim 1 wherein said monitor includes a carrier having a marking and a sensor which scans the marking, one of said carrier and said sensor being movable with said feed mechanism and the other being stationary.

6. A sewing station according to claim 1 wherein said sensor emits a switching signal to said feed device and said feed device includes a drive mechanism for positioning said holder which is turned off by said signal.

7. A device for controlling the position of a workpiece in a sewing machine having a drive for a needle which reciprocates at a sewing station to sew a workpiece, comprising a holder engageable with the workpiece for advancing it through a sewing station through a selected path, a feed device driven by the drive and connected to said holder for moving said holder with the workpiece, and monitor means associated with said holder for monitoring the position of said holder and connected to said feeding device for controlling the movement of said holder.

8. A device according to claim 7 wherein said feed device includes a motor for driving said holder in respective oriented directions and wherein said monitor means includes means for regulating each of said motors.

9. A device according to claim 8 wherein said control for each of said motors includes means to stop said motors and said monitor indicates that said holder is not being moved through a selected path.

10. A device according to claim 7 wherein said monitor means includes a member having a marking and a sensor for scanning said marking.

11. A device according to claim 10 wherein said holder includes a stitch slit through which the needle extends when it is movable to act on the workpiece and wherein said monitor means includes an area having a marking corresponding to the stitch slit associated and associated with said feed means.

* * * * *